US008511376B2

(12) United States Patent
Yokley

(10) Patent No.: US 8,511,376 B2
(45) Date of Patent: Aug. 20, 2013

(54) DOWNHOLE C-RING SLIP ASSEMBLY

(75) Inventor: John M. Yokley, Kingwood, TX (US)

(73) Assignee: Dril-Quip, Inc., Houston, TX (US)

( * ) Notice: Subject to any disclaimer, the term of this patent is extended or adjusted under 35 U.S.C. 154(b) by 196 days.

(21) Appl. No.: 12/837,116

(22) Filed: Jul. 15, 2010

(65) Prior Publication Data

US 2012/0012305 A1 Jan. 19, 2012

(51) Int. Cl.
*E21B 23/01* (2006.01)

(52) U.S. Cl.
USPC ..... 166/216; 166/75.14; 166/208

(58) Field of Classification Search
USPC ..... 166/382, 88.2, 88.3, 75.14, 208, 166/216, 209, 217, 118
See application file for complete search history.

(56) References Cited

U.S. PATENT DOCUMENTS

| | | | | |
|---|---|---|---|---|
| 1,066,000 | A | 7/1913 | Crumpton | |
| 3,026,941 | A * | 3/1962 | Muse | 166/216 |
| 3,530,934 | A * | 9/1970 | Kisling | 166/134 |
| 3,643,737 | A * | 2/1972 | Current et al. | 166/216 |
| 4,047,568 | A * | 9/1977 | Aulenbacher | 166/298 |
| 4,441,553 | A * | 4/1984 | Setterberg et al. | 166/138 |
| 4,457,369 | A * | 7/1984 | Henderson | 166/125 |
| 4,512,399 | A | 4/1985 | Gano et al. | |
| 4,582,134 | A * | 4/1986 | Gano et al. | 166/120 |
| 4,582,135 | A * | 4/1986 | Akkerman | 166/134 |
| 5,174,397 | A * | 12/1992 | Currington | 175/423 |
| 5,413,180 | A | 5/1995 | Ross et al. | |
| 5,492,173 | A * | 2/1996 | Kilgore et al. | 166/66.4 |
| 5,701,954 | A * | 12/1997 | Kilgore et al. | 166/119 |
| 5,906,240 | A * | 5/1999 | Kilgore et al. | 166/217 |
| 5,944,102 | A * | 8/1999 | Kilgore et al. | 166/119 |
| 6,481,497 | B2 * | 11/2002 | Swor et al. | 166/134 |
| 6,655,456 | B1 | 12/2003 | Yokley et al. | |
| 6,715,560 | B2 * | 4/2004 | Doane et al. | 166/387 |
| 6,739,398 | B1 | 5/2004 | Yokley et al. | |
| 6,761,221 | B1 * | 7/2004 | Yokley et al. | 166/382 |
| 7,341,110 | B2 * | 3/2008 | Doane et al. | 166/387 |
| 7,607,476 | B2 * | 10/2009 | Tom et al. | 166/207 |
| 2007/0102165 | A1 * | 5/2007 | Slup et al. | 166/387 |
| 2008/0047704 | A1 * | 2/2008 | Tom et al. | 166/118 |
| 2011/0247832 | A1 * | 10/2011 | Harris | 166/382 |
| 2012/0012305 | A1 * | 1/2012 | Yokley | 166/208 |

* cited by examiner

*Primary Examiner* — Jennifer H Gay
(74) *Attorney, Agent, or Firm* — Baker Botts L.L.P.

(57) ABSTRACT

A slip assembly (60) for securing a tool in a well includes an upper and a lower c-ring slip body (12, 14) each including an outer gripping surface (16, 18) and inner gripping surface (20, 22). An actuator member (68) is axially movable relative to both slip bodies and includes a camming surface (70) for engagement with the upper and lower slip bodies. The slip assembly withstands high axial loads, and forces are equally distributed between the slip bodies.

20 Claims, 8 Drawing Sheets

DOWNHOLE C-RING SLIP ASSEMBLY

FIELD OF THE INVENTION

The present invention relates to downhole slip assemblies of the type used to secure a tool within a downhole tubular in a well. More particularly, this invention relates to a downhole slip assembly having a c-ring slip construction capable of reliably withstanding high axial loads.

BACKGROUND OF THE INVENTION

Various types of slip assemblies have been devised for securing a tool at a desired depth within a downhole tubular. Many such devices include multiple slips, slip arms, cages, and cones. Slip assemblies with dozens of downhole components are inherently a reliability concern. For example, slip segments may fall off a respective slip arm, causing failure of the downhole tool. Slip assemblies including numerous components may also cause local overstressing of the downhole casing or other tubular due to tolerance variation buildup, thereby causing casing failure due to the non-uniformity of distributing stresses over all the slip segments.

Reducing overstressing of a liner hanger body or a casing from a slip assembly in high axial load applications conventionally requires a sufficient slip area to handle the demanding loads. Increased loads may be the result of the longer and heavier liners, and their corresponding increased test pressures. To achieve additional slip area, additional slips and cones may be used, or the slip taper length may be made longer to achieve more slip area without adding system components.

U.S. Pat. No. 1,066,000 discloses slips for anchoring in a well. The well packer disclosed in U.S. Pat. Nos. 4,512,399 and 4,582,134 include slips and an expander with tapered expansion surfaces. U.S. Pat. No. 5,413,180 discloses a gravel packing service tool with slips. U.S. Pat. No. 5,906,240 discloses a c-ring slip having a passageway for installation of lines therethrough. U.S. Pat. No. 6,655,456 discloses a liner hanger assembly, and U.S. Pat. No. 6,761,221 discloses a liner hanger assembly with a c-ring slip body as shown in FIGS. 2A and 5. U.S. Pat. No. 6,739,398 discloses a linger hanger running tool with c-ring slips, as shown in FIGS. 1G, 2B, 8E, and 9A.

The disadvantages of the prior art are overcome by the present invention, and an improved slip assembly for securing a tool within a downhole tubular in a well is hereinafter disclosed.

SUMMARY OF THE INVENTION

In one embodiment, a slip assembly is provided for securing a tool or tubular within another downhole tubular in a well. An upper c-ring slip body and a lower c-ring slip body each include a plurality of circumferentially spaced outer gripping surfaces. An actuator member is axially movable relative to both the upper and lower c-ring slip bodies, and has camming surfaces for engagement with each slip body, which preferably is biased radially outward for engagement with the downhole tubular. A plurality of circumferentially spaced and axially extending slats interconnect the upper and lower slip bodies, with each slat having a outer slat surface spaced radially inward of the upper and lower gripping surfaces.

These and further features and advantages of the present invention will become apparent from the following detailed description, wherein reference is made to the figures in the accompanying drawings.

DETAILED DESCRIPTION OF PREFERRED EMBODIMENTS

Figure 1:
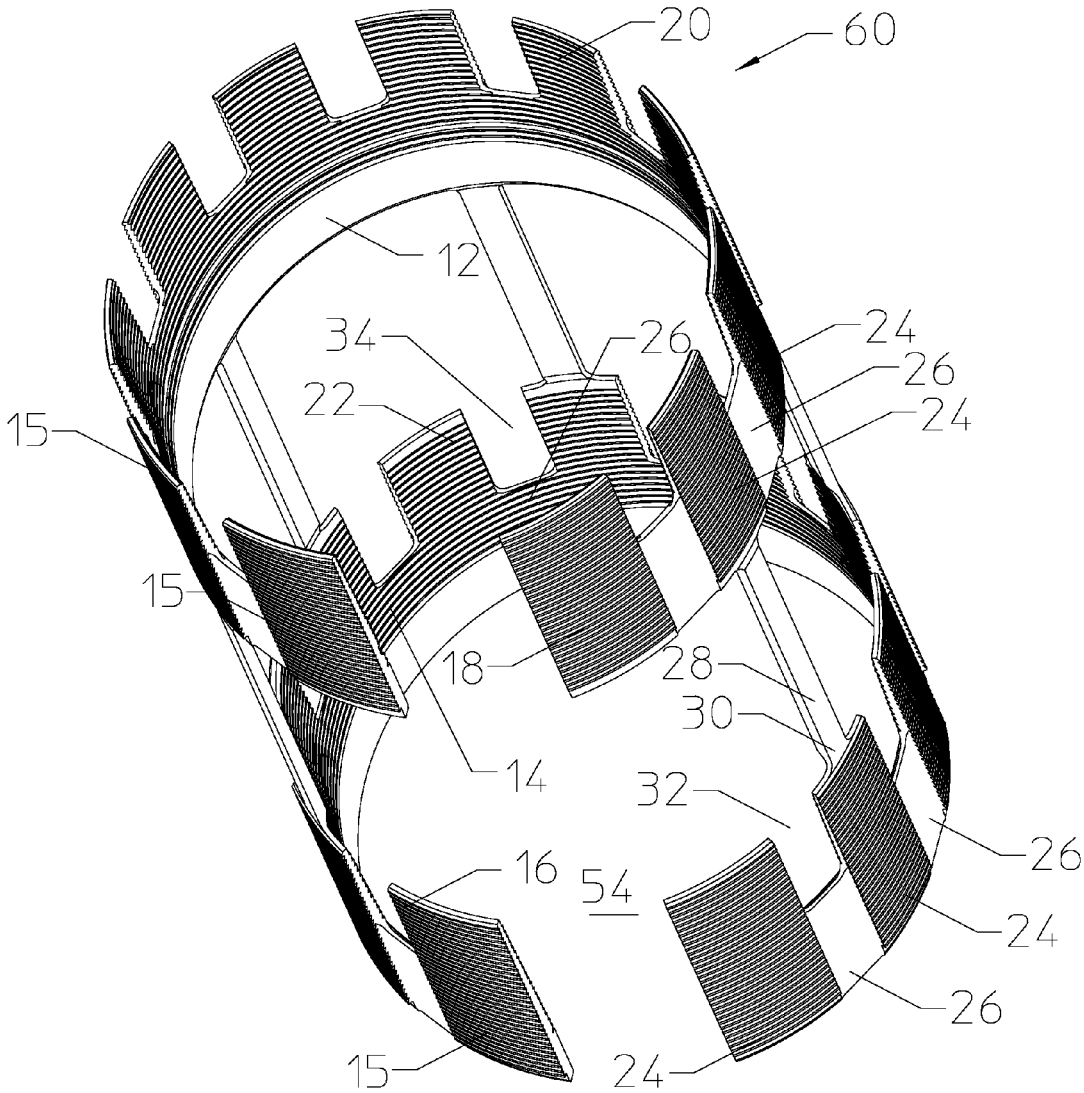
FIG. 1 is an isometric view of the c-ring slip assembly according to the present invention.

FIG. 1 depicts a c-ring slip assembly 60 which includes an upper c-ring slip body 12 and a lower c-ring slip body 14 each including a plurality of circumferentially spaced outer gripping surfaces 18 and 16, respectively and also preferably including a plurality of circumferentially spaced inner gripping surfaces 20, 22, which also serve as cam engaging surfaces, as discussed below. Each c-ring slip body thus includes a plurality of circumferentially spaced gripping members 24, with connecting sections 26 on each slip body not including outer gripping surfaces thereon, but instead circumferentially and fixedly interconnecting the circumferentially spaced gripping members 24. Each c-ring slip body preferably has a circumferential span of at least 250°, and preferably at least 300°.

As shown in FIG. 1, the upper and lower c-rings 12, 14 are spaced axially apart, with this fixed axial spacing being provided by a plurality of circumferentially spaced and axially extending slats 28 which rigidly interconnect the upper c-ring slip body 12 and the lower c-ring slip 14. Each slat has an outer slat surface 30 which is spaced radially inward of both the adjacent upper and lower outer gripping surfaces on the upper and lower slip bodies, so that the slats 28 do not interfere with the slips gripping an outer tubular body, and allow fluid to flow axially in the gap between a slat 28 and the tubular to be gripped by the slip assembly. In a preferred embodiment, the c-ring slip assembly as shown in FIG. 1 is biased radially outward, and may be retained in an inward position until released, at which time the outward bias will cause the slip bodies to engage the downhole outer tubular. An actuator hanger body 68 as discussed below may force the outer gripping surfaces 18, 16 into secured engagement with an outer tubular and may force inner gripping surfaces 20, 22 into secured engagement with an exterior surface of a tool component, such as actuator hanger body 68. A portion of sections 26 may be cut away to reduce the axial length of each connecting section, as shown in FIG. 1, thereby providing for axially extending cutouts 34, 32 which result in an enhanced flow past the set c-ring slip assembly.

Figure 2:
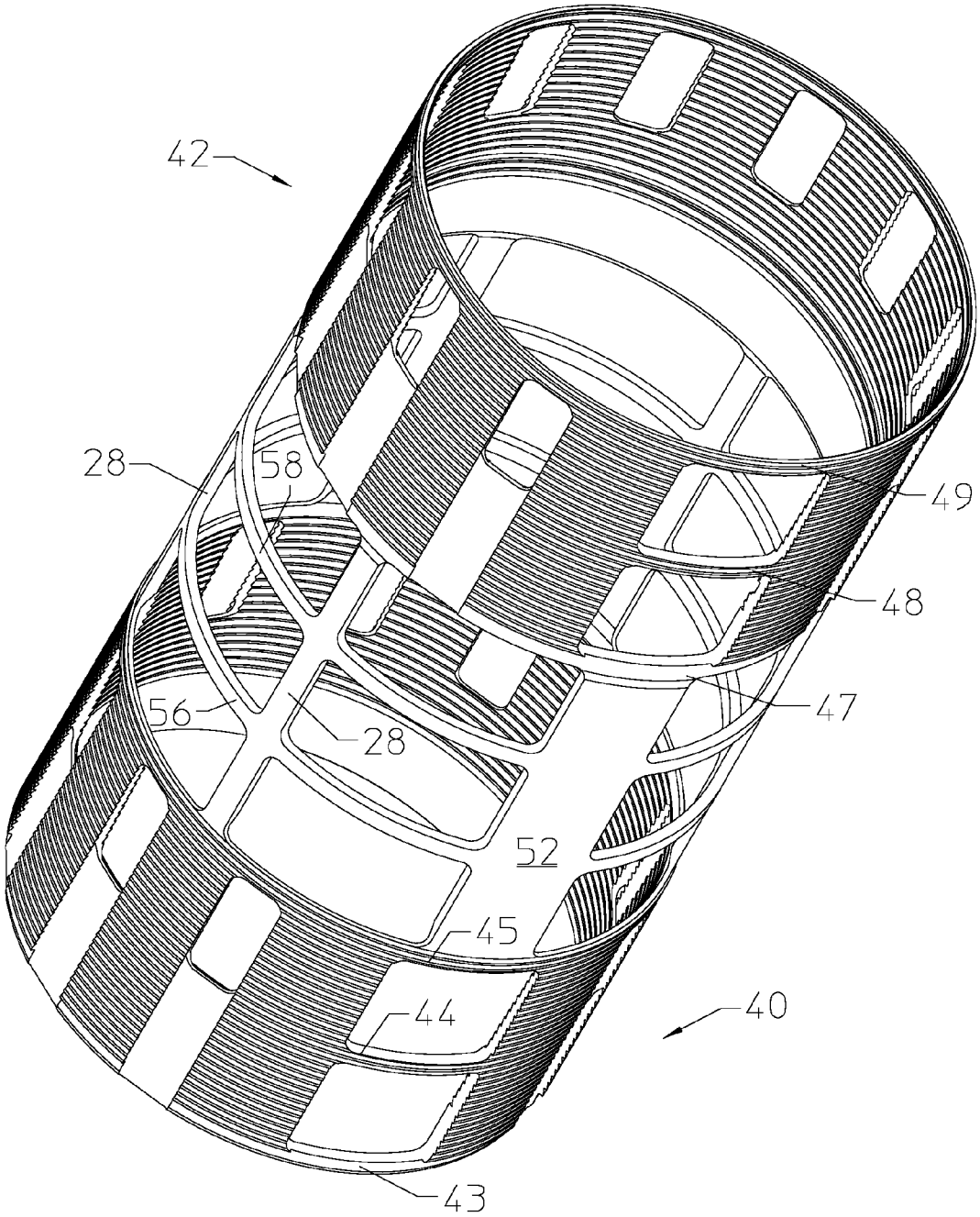
FIG. 2 is an isometric view of the c-ring slip assembly after a machining operation and before heat treating.

FIG. 2 depicts a c-ring slip assembly after machining and prior to stress relieving and hardening. If the assembly were manufactured as shown in FIG. 1 and then heat treated, the assembly would be subjected to high stress points, and likely would significantly deform as a result of the heat treating process. Since warping of a slip body may undesirably cause nonuniform loading of the slip body on the casing being gripped by the slip assembly, the unit as shown in FIG. 2 may be initially machined with an lowermost complete ring 40 and an uppermost complete ring 42, and with circumferential bars 43, 44, 45 and 47, 48, 49 interconnecting the ends of each c-ring. Each of these bars is removed by machining after stress relief and hardening operations, and removal of these components along with large slat 52 ultimately creates a circumferential gap 54 as shown in FIG. 1 between the ends of each of the upper and lower c-rings. The connection sections 26 each between a pair of circumferentially spaced gripping members 24 as shown in FIG. 1 may be formed by removing portions of bars 49 and 45 after stress relief and hardening operations. The circumferential bars 45 and 49 preferably extend between ends of adjacent gripping members 24 to maintain the desired shape of the slip assembly during heat treating. FIG. 2 also depicts a plurality of circumferential bars 56, 58 which act between circumferentially spaced slats 28. These additional axially spaced bars also maintain the desired geometry of the slip assembly during heat treating, and subsequently are removed by machining for creating a sizable gap between adjacent slats 28. The circumferential width of each slat 28 preferably is less than the circumferential width of each gap 32, 34 between adjacent gripping members 24.

The configuration of the slip assembly as shown in FIG. 2 thus maintains the desired configuration and close tolerances between components for the c-ring slip assembly during machining, stress relief, and tooth hardening operations. Machining is also performed with radiused corners to reduce stress concentration points.

Referring again to FIG. 1, the reduced diameter of the circumferentially spaced connecting sections 26 forms a circumferential and radial gap between each connecting section and the radially outward tubular to be gripped, thereby forming a fluid flow channel when the slip assembly is set. Moreover, each of the plurality of upper and lower gripping members 24 include axially extending slip portions 15, as shown in FIG. 1, which extend axially beyond the adjacent connecting sections 26 to form a circumferential gap 32, 34 between adjacent gripping members, so that the axial length of connection section 26 is less than the axial length of the adjacent gripping members 24.

Each C-ring body 12, 14 preferably includes a solid C-shaped ring, as shown in FIG. 1. The upper C-ring slip body, the lower C-ring slip body, and the plurality of slats are preferably formed as a unitary structure, and preferably a monolithic structure. The entire slip assembly as shown in FIG. 1 may thus first be machined from a single tubular piece to form the shape as shown in FIG. 2, then the slip assembly subjected to stress relief and slip tooth hardening operations, and subsequently machined to form the final shape as shown in FIG. 1.

Figure 3:
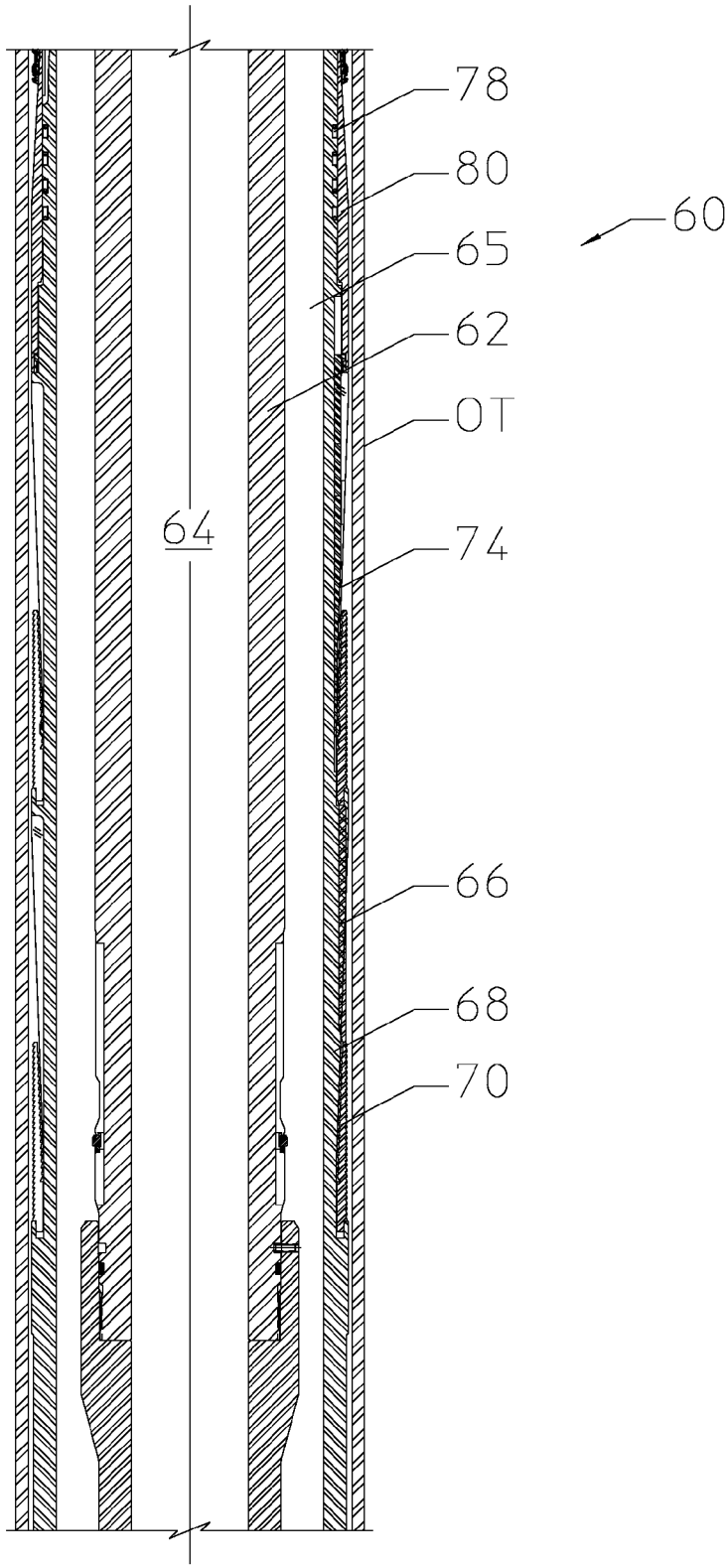
FIG. 3 is a side view of a portion of a c-ring slip assembly in the reduced diameter or run-in configuration, and portions of the slip assembly are shown in greater detail in FIGS. 4 and 5.

Referring now to FIG. 3, the slip assembly 60 on the downhole tool is positioned within an outer tubular OT at the desired depth in the well. The tool includes a mandrel 62 having a central bore 64 for passage of fluid. An annulus 65 thus exists between the OD of mandrel 62 and the ID of actuator member 68. The slip assembly as shown in FIG. 3 is thus in the reduced diameter or run-in position with the gripping surface 16, 18 as shown in FIG. 1 being out of engagement with the inner surface of the outer tubular OT. An actuator member, such as liner hanger actuator body 68, is provided radially within the slip body and includes upper and lower tapered camming surfaces 69, 70 (see FIG. 6) for sliding engagement with the interior surfaces 20, 22 of the slip body (see FIG. 1). Actuator member 68 is thus moved axially with respect to the slip body to set the slips, and may be powered by various mechanisms, including hydraulically actuated pistons and/or set down weight. Various types of seals 78 may be used to seal between the actuator 68 and the packer sleeve 80 shown in FIG. 3, including O-ring or Chevron-type packing in one or more grooves.

Figure 4:
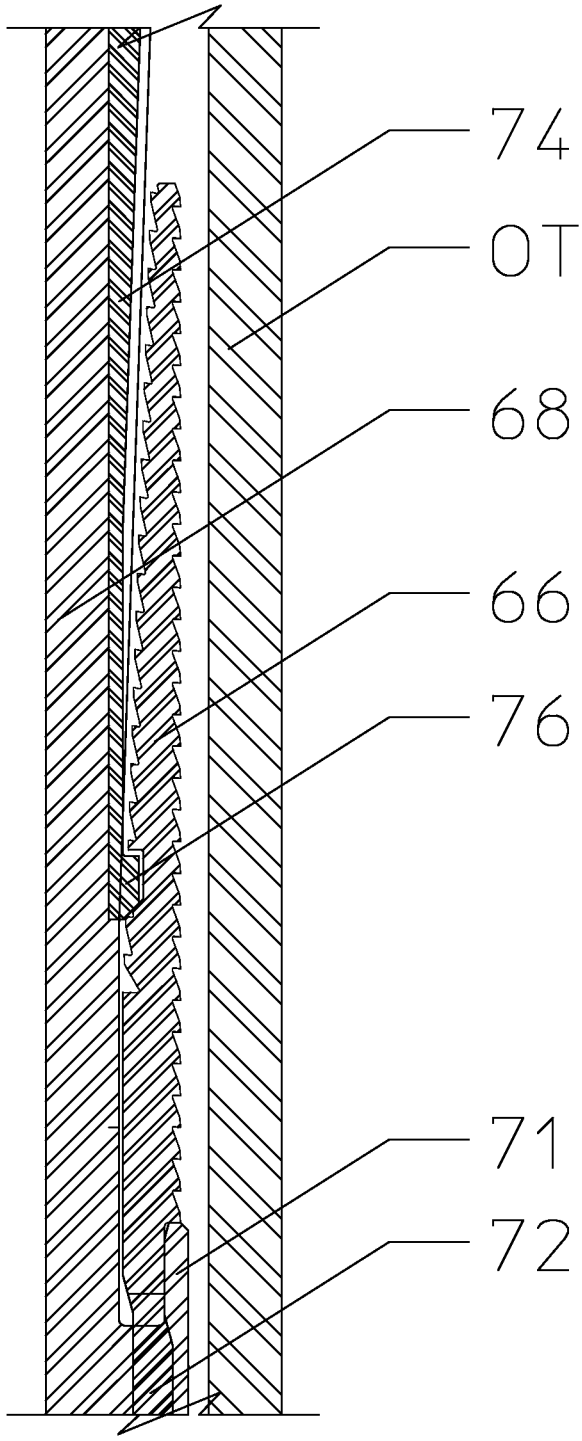
Figure 5:
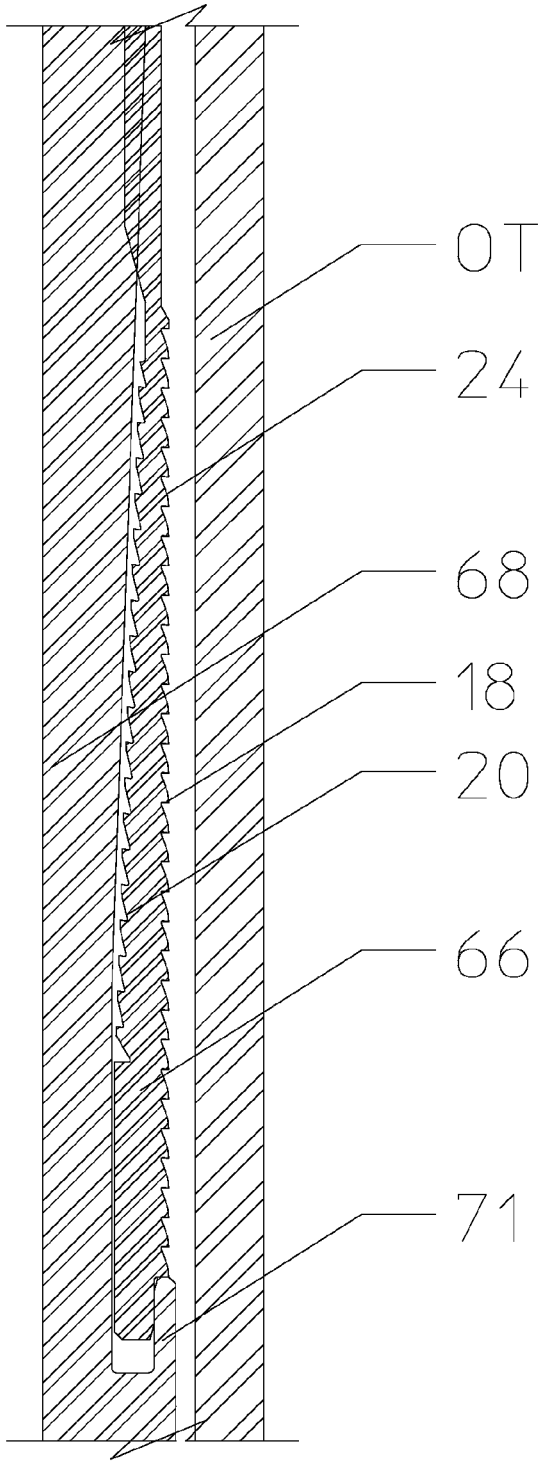

FIG. 4 is an enlarged view of an upper portion of the slip assembly shown in FIG. 3 and illustrates in greater detail tie bars 74 extending downward to the slip body and having a catch member 76 at the lower end thereof for fitting within the respective groove in the slip body to hold the slip body in the run-in position. Each of the upper and lower slip bodies 66 may be biased radially outward, and includes a retainer 71 as shown in FIG. 4 for preventing the slip body from moving radially outward into engagement with the outer tubular OT until the cone packer sleeve 80 (see FIG. 3) and the tie bars 14 move axially to release the slip body. FIG. 5 is a detailed view of a lower portion of the slip assembly shown in FIG. 3, and illustrates the radially outer teeth 16 and the inner teeth 22 shown in FIG. 1.

Figure 6:
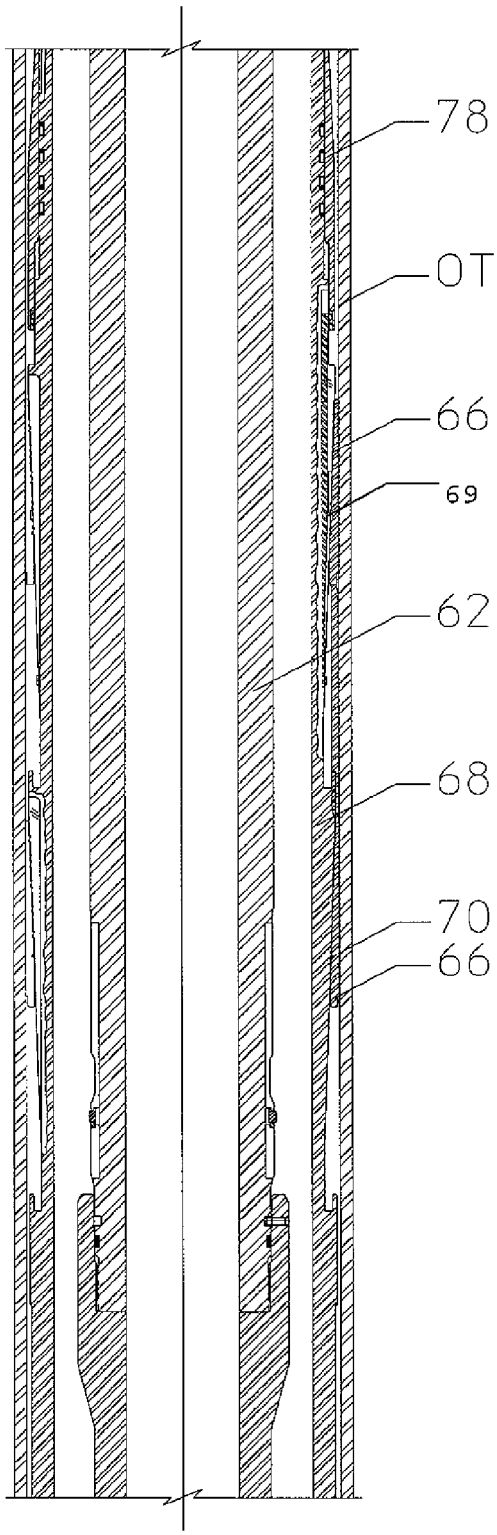
FIG. 6 is a side view of a portion of a c-ring slip assembly in the engaged or enlarged diameter position, and portions of the slip assembly are shown in greater detail shown in FIGS. 7 and 8.
Figure 7:
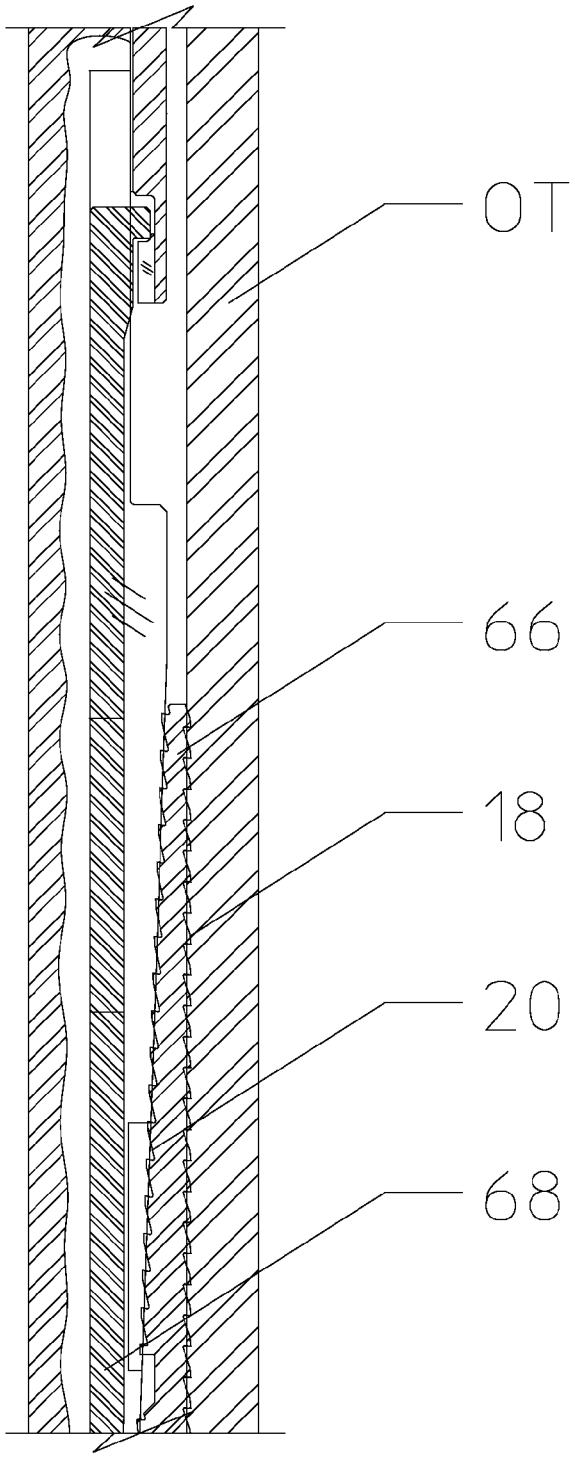
Figure 8:
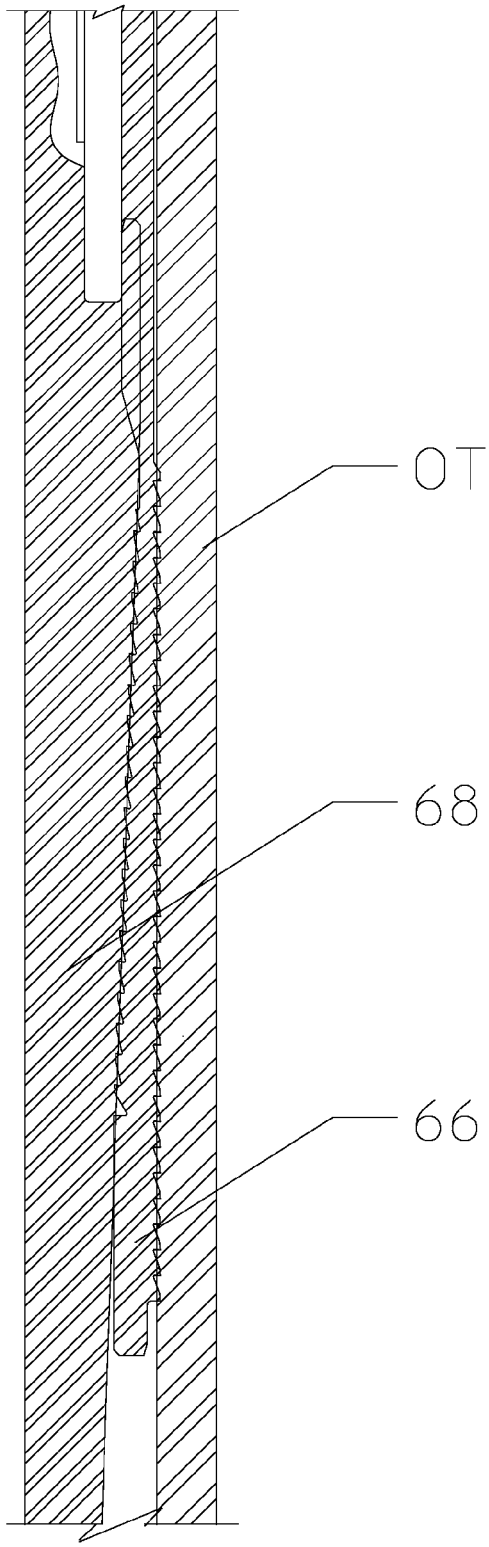

In FIG. 6, the actuator member 68 has moved downward, so that the inner camming surfaces on the actuator member slidably engage the inner surfaces on the slip body, thereby forcing the slip body into gripping engagement with the outer tubular OT. It should be understood that the upper and lower gripping surfaces on the slip body may be formed by axially spaced gripping teeth, although various other forms for grippingly engaging the tubular may be provided, including grit surfaces. Teeth 16, 18 on the outside of each gripping member 24, as shown more clearly in FIG. 7, may have downwardly angled teeth, so that the teeth dig into the outer tubular OT and prevent the slip assemblies from sliding downward with respect to the outer tubular. The inner surface 20, 22 on the slip bodies 12 and 14 may have upwardly projecting teeth, so that these inner teeth engage the slip and force the slip to bite into the exterior tapered surface of the actuator member when the actuator member moves downward, thereby axially locking the position of the actuator member with respect to the outer tubular OT.

By providing a slip body as disclosed herein including an upper C-ring slip body and a lower C-ring slip body, substantial axial forces may be transferred from a slip assembly to the tubular being gripped. It is significant that the desired high gripping forces are uniformly applied to each gripping surface on the slip body, and this objective is obtained by providing a unitary and preferably a monolithic slip body, as disclosed herein. This unitary slip body thus cooperates with an actuator member which is also unitary from at least that part of the camming surface on the actuator member which engages the interior surfaces of the upper C-ring slip members 12 and the actuator member camming surfaces which engage the lower C-ring slip members 14. Significant advantages are obtained by greatly reducing the number of slip assembly components compared to prior art assemblies. Moreover, dimensional stability is achieved between camming surfaces on the actuator member, the interior surfaces of the slip bodies engaged by the actuator member, and the outer gripping surfaces of the slip body which engage the tubular being gripped. Manufacturing tolerances may thus ensure that each of the upper C-ring slip body and lower C-ring slip body are released together and move simultaneously outward to uniformly engage the tubular. Moreover, the upper and lower slips are axially "fixed" or spaced apart relate to the actuator camming surfaces so that the actuator exerts substantially the same radial force on each slip, which in turn exerts substantially the same force on the tubular being gripped. The taper on the camming surfaces of the actuator member and the slip body may be controlled to accommodate the desired load. In some applications, three or more integral slip bodies may be provided each moving in response to a single actuator.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A slip assembly for securing a tool or tubular within another downhole tubular in a well, the slip assembly comprising:

an upper C-ring slip body including a plurality of circumferentially spaced outer upper gripping surfaces and a plurality of interior upper gripping surfaces, the upper C-ring slip body including a plurality of portions each circumferentially connecting two of the plurality upper gripping portions;

a lower C-ring slip body including a plurality of circumferentially spaced outer lower gripping surfaces and a plurality of interior lower gripping surfaces, the upper C-ring slip body being axially spaced from the lower C-ring slip body, the lower C-ring slip body including a plurality of portions each circumferentially connecting two of the plurality lower gripping portions;

the plurality of outer upper gripping surfaces and the plurality of outer lower gripping surface each grippingly engaging an interior surface of the another downhole tubular, and the plurality of interior upper gripping surface and the plurality of interior lower gripping surfaces each grippingly engaging on exterior surface of the tool or tubular;

an actuator member axially movable relative to both the upper and lower C-ring slip bodies, the actuator member having a radially outer upper camming surface for engagement with the plurality of interior upper surfaces on the upper C-ring slip body and a radially outer lower camming surface axially fixed relative to the upper camming surface for engagement with the plurality of interior lower surfaces on the lower C-ring slip body; and a plurality of circumferentially spaced and axially extending slats each axially fixedly interconnecting the upper C-ring slip body and the lower C-ring slip body, each slat having an outer slat surface radially inward of the upper and lower outer gripping surfaces.

2. A slip assembly as defined in claim 1, wherein each of the upper C-ring slip body and the lower C-ring slip body is biased radially outward for engagement with the another downhole tubular.

3. A slip assembly as defined in claim 2, further comprising:

a retainer for removably engaging the upper C-ring slip body and the lower C-ring slip body and preventing radially outward movement of the upper C-ring slip body and the lower C-ring slip body prior to axial movement of the actuator member.

4. A slip assembly as defined in claim 1, wherein a circumferential gap between adjacent axially extending slats forms a fluid flow channel when the slip assembly is set.

5. A slip assembly as defined in claim 4, wherein each of the plurality of outer upper gripping surfaces and each of the plurality of outer lower gripping surfaces include circumferentially spaced and axially extending slip body portions each circumferentially spaced from another of the slip body portions by an axially extending gap.

6. A slip assembly as defined in claim 1, wherein each of the plurality of slats has a circumferential width less than a circumferential width of a circumferential gap between circumferentially adjacent slats.

7. A slip assembly as defined in claim 1, wherein each slip body includes a solid C-shaped ring.

8. A slip assembly as defined in claim 1, wherein the upper C-ring slip body, the lower C-ring slip body and the plurality of slats are formed as a unitary structure.

9. A slip assembly as defined in claim 8, wherein the upper C-ring slip body, the lower C-ring slip body and the plurality of slats are formed as a monolithic structure.

10. A slip assembly as defined in claim 1, wherein each of the plurality of upper gripping surfaces and lower gripping surfaces include axially spaced gripping teeth.

11. A slip assembly for use with an axially movable actuator member for securing a tool or a tubular within another downhole tubular in a well, the slip assembly comprising:

an upper C-ring slip body including a plurality of circumferentially spaced outer upper gripping surfaces and a radially interior upper gripping surface;

a lower C-ring slip body including a plurality of circumferentially spaced outer lower gripping surfaces and a radially interior lower gripping surface, the upper C-ring slip body being axially spaced from the lower C-ring slip body;

a plurality of circumferentially spaced and axially extending slats each fixedly interconnecting the upper C-ring slip body and the lower C-ring slip body; and each of the plurality of outer upper gripping surfaces and each of the plurality of outer lower gripping surfaces are circumferentially spaced from another of the respective outer upper gripping surfaces and the outer lower gripping portions by a circumferential gap.

12. A slip assembly as defined in claim 11, wherein each of the upper C-ring slip body and the lower C-ring slip body is biased radially outward for engagement with the another downhole tubular.

13. A slip assembly as defined in claim 11, wherein the upper C-ring slip body, the lower C-ring slip body and the plurality of slats are formed as a monolithic structure.

14. A slip assembly as defined in claim 11, wherein each of the plurality of outer upper gripping surfaces are interconnected by a solid C-shaped ring, and each of the plurality of outer upper gripping surfaces extend axially from the solid C-shaped ring.

15. A slip assembly for securing a tool or tubular within another downhole tubular in a well, the slip assembly comprising:

an upper C-ring slip body including a plurality of circumferentially spaced and axially extending outer upper gripping surfaces and a radially interior upper cam engaging surface;

a lower C-ring slip body including a plurality of circumferentially spaced and axially extending outer lower gripping surfaces and a radially interior lower cam engaging surface, the upper C-ring slip body being axially spaced from a lower C-ring slip body;

an actuator member axially movable relative to both the upper and lower C-ring slip bodies, the actuator member having a radially outer upper cam engaging surface for sliding engagement with the interior upper camming surface on the upper C-ring slip body and a radially outer lower camming surface axially fixed relative to the upper camming surface for sliding engagement with the interior lower camming surface on the lower C-ring slip body;

a plurality of axially extending slats each fixedly interconnecting the upper C-ring slip body and the lower C-ring slip body; and each of the plurality of outer upper gripping surfaces are interconnected by an upper C-shaped ring, and each of the plurality of outer lower gripping surfaces are interconnected by a lower C-shaped ring.

16. A slip assembly as defined in claim 15, further comprising:

a retainer for preventing radially outward movement of the upper C-ring slip body and the lower C-ring slip body prior to axial movement of the actuator member.

17. A slip assembly as defined in claim 15, wherein each of the radially interior upper camming surfaces and the radially interior lower camming surfaces include teeth for engagement with the respective upper camming surface and lower camming surface on the actuator member.

18. A slip assembly as defined in claim 15, wherein each of the plurality of outer upper gripping surfaces and each of the plurality of outer lower gripping surfaces are circumferentially spaced from another of the outer upper gripping surfaces and another of the outer lower gripping surfaces, respectively, by a circumferential gap.

19. A slip assembly as defined in claim 15, wherein the upper C-ring slip body, the lower C-ring slip body and the plurality of slats are formed as a monolithic structure.

20. A slip assembly as defined in claim 15, wherein a circumferential gap between adjacent axially extending slats forms a fluid flow channel when the slip assembly is set.

* * * * *